US006289562B1

(12) United States Patent
Linder et al.

(10) Patent No.: US 6,289,562 B1
(45) Date of Patent: Sep. 18, 2001

(54) UNFOLDING CLASP FOR A BRACELET

(75) Inventors: Stéphane Linder; Thanas Lipe, both of Marin-Epagnier (CH)

(73) Assignee: Tag Heuer SA, Marin-Epagnier (CH)

( * ) Notice: Subject to any disclaimer, the term of this patent is extended or adjusted under 35 U.S.C. 154(b) by 0 days.

(21) Appl. No.: 09/463,306

(22) PCT Filed: Jul. 20, 1998

(86) PCT No.: PCT/CH98/00315

§ 371 Date: Feb. 2, 2000

§ 102(e) Date: Feb. 2, 2000

(87) PCT Pub. No.: WO99/05930

PCT Pub. Date: Feb. 11, 1999

(30) Foreign Application Priority Data

Jul. 28, 1997 (CH) ..... 1801/97

(51) Int. Cl.[7] ..... A44C 5/24

(52) U.S. Cl. ..... 24/715; 24/265 WS

(58) Field of Search ..... 24/265 WS, 71 R–71 SD, 24/68 J, 705, 69 J; 63/3, 3.1; 224/164, 176; 368/282

(56) References Cited

U.S. PATENT DOCUMENTS 2,394,856 * 2/1946 Hickman .
4,178,751 12/1979 Liautaud .
4,542,561 * 9/1985 Hysek .
4,545,094 * 10/1985 Fontana .
4,545,095 * 10/1985 Fontana .
5,331,729 * 7/1994 Mathieu .
5,579,559 * 12/1996 Ferrario .
5,689,859 * 11/1997 Cuche .

FOREIGN PATENT DOCUMENTS 635 237 A5 3/1983 (CH) .
668 353 A5 12/1988 (CH) .
678 002 A5 7/1991 (CH) .
684 151 A5 7/1994 (CH) .
0 199 708 A2 10/1986 (EP) .
0 344 620 A1 12/1989 (EP) .
0 453 635 A1 10/1991 (EP) .
2 571 228 A1 4/1986 (FR) .
2 577 120 A1 8/1986 (FR) .

* cited by examiner

*Primary Examiner*—James R. Brittain
(74) *Attorney, Agent, or Firm*—Oliff & Berridge PLC

(57) ABSTRACT

Unfolding clasp (1) for a bracelet (4), comprising two lateral, articulated plates (10) with a central plate (11) so as to be able to ensure the opening of the bracelet.

The plates (10, 11) are made of a flexible material able to adopt the shape of the wrist of the wearer of the bracelet. The deformation of the plates caused by a force applied perpendicular to the plane (x, z) containing the plates is greater than the deformation of the plates caused by an identical force applied in any other direction.

The plates are made of a composite material, for example including a metallic reinforcement (100, 110) covered by a flexible material (101, 111) such as caoutchouc, plastic or leather.

14 Claims, 3 Drawing Sheets

FIG. 1
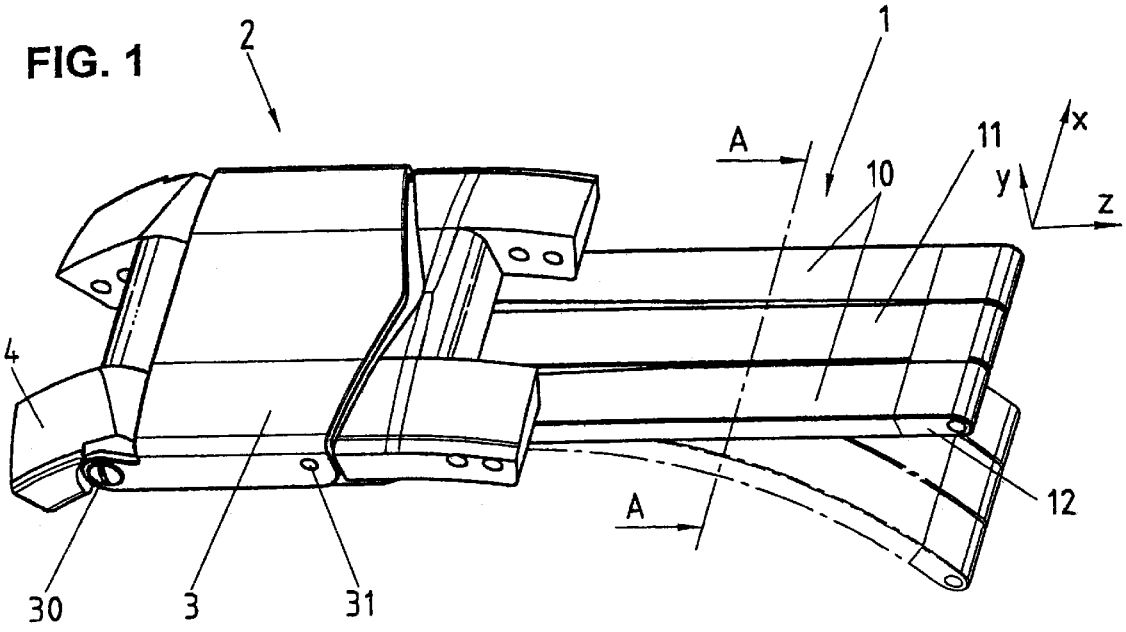
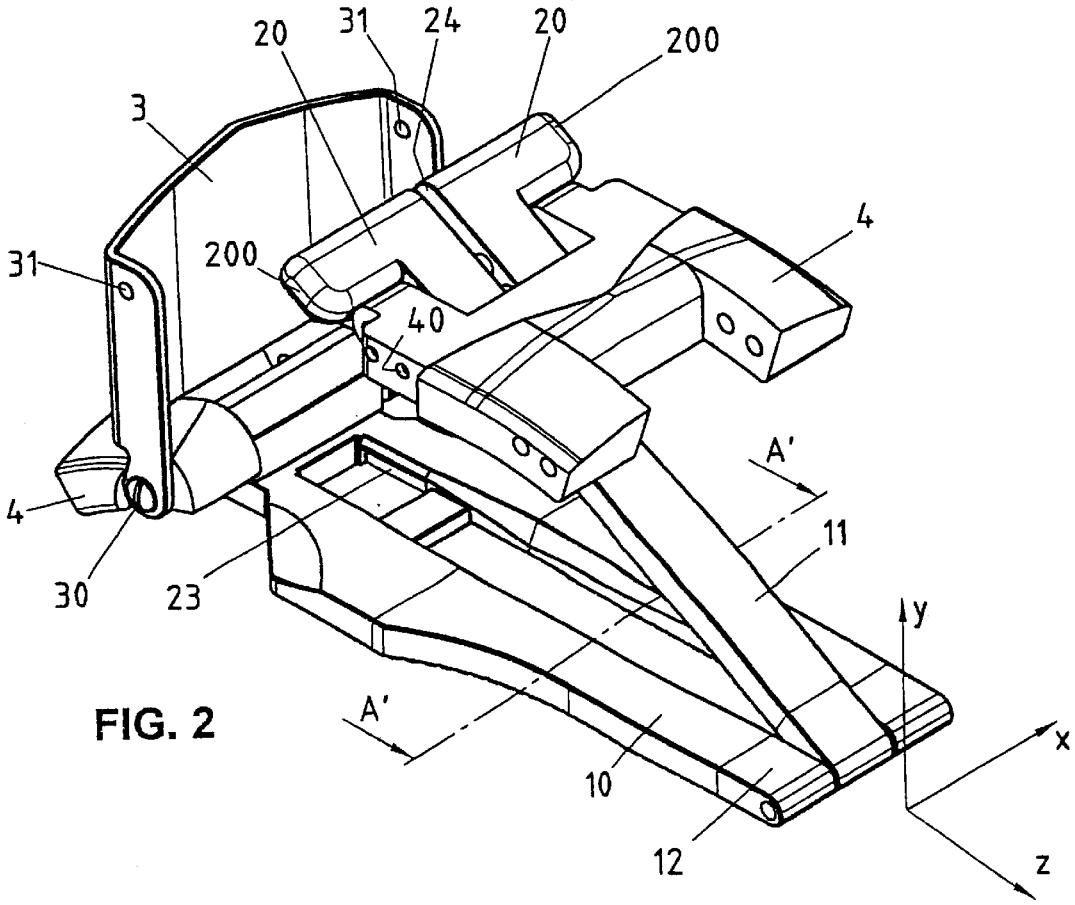
FIG. 2

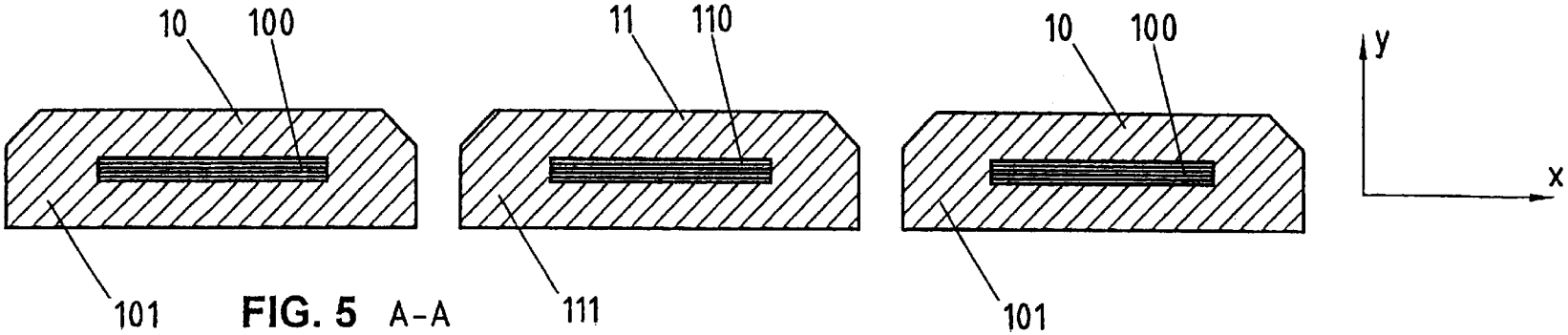
FIG. 5 A-A
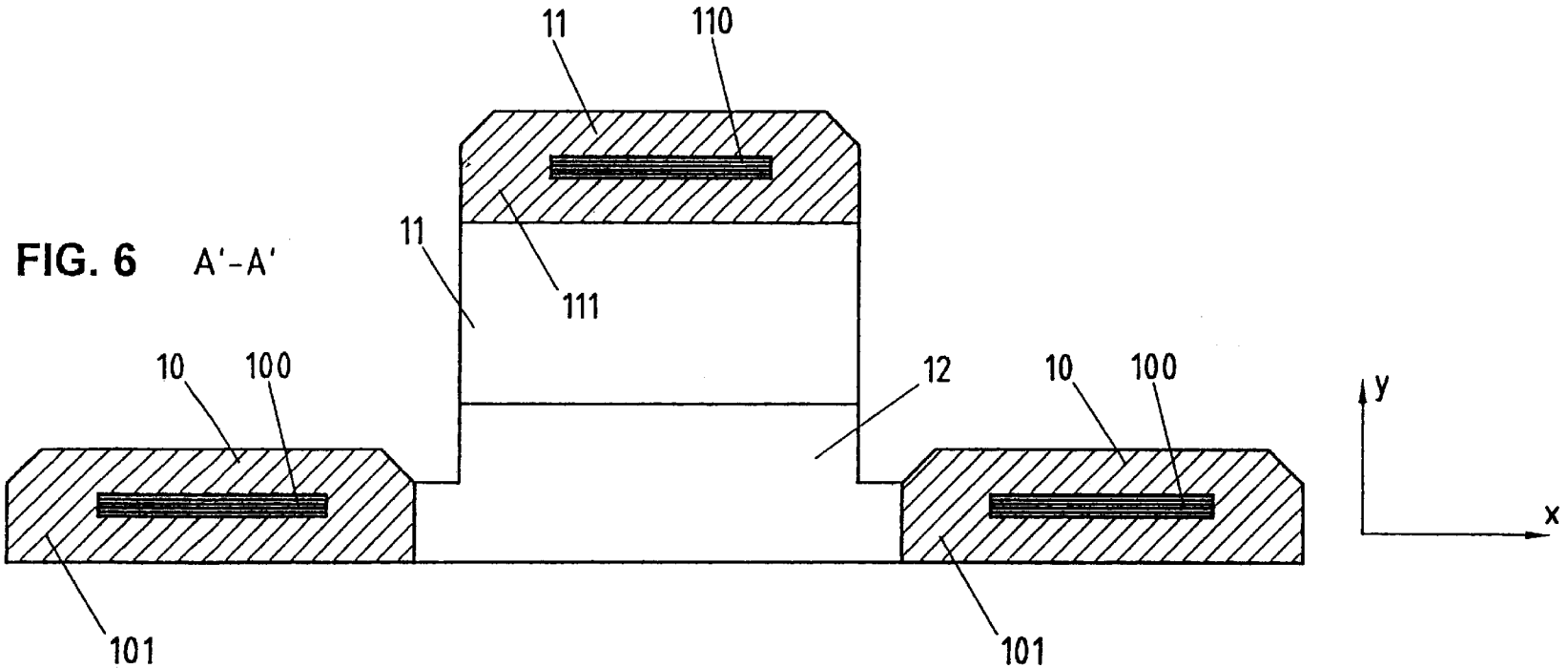
FIG. 6 A'-A'

UNFOLDING CLASP FOR A BRACELET

This invention concerns an unfolding clasp for a bracelet, in particular an unfolding clasp for a watch bracelet or watchband.

BACKGROUND OF RELATED ART

Watch bracelets or watchbands are either of the open type or of the closed type. Understood by open-type is one whose two ends can be disunited. The ring formed by the watch and the bracelet can thus be opened to slip on the bracelet. Understood by closed-type is one whose two ends remain integral. Bracelets of the closed type generally comprise an unfolding clasp enabling the diameter to be increased of the ring formed by the bracelet and the watch, so that the hand can pass through. The present invention concerns just such an unfolding clasp for a bracelet or band, in particular one of the closed type.

Different types of unfolding clasps are known, all of which however generally comprise at least two mutually articulated plates as well as a closure. In is closed position, the plates are generally folded up, one on the other, or one next to the other, and are held in this position by an appropriate device. By actuating the closure, the user can release this device to unfold the articulated plates in such a way as to enlarge the opening of the bracelet. The patent documents FR 2 571 228, FR 2 577 120, CH 684 151, CH 678 002 and CH 635 237, for example, describe different types of unfolding clasps for bracelets or bands.

The unfolding of the clasp must be sufficient to allow, in opened position, passage of the hand through the opening of the bracelet, while sufficiently clasping the wrist when in closed position. The common unfolding clasps generally allow the circumference of the bracelet to be varied by about three to six centimeters.

Different constructions have been conceived, with a variable number of plates folding up in diverse ways, which allow such an unfolding to be obtained. The width and the thickness of the plates, however, must be sufficient to ensure reliable functioning of the unfolding clasp, even after a large number of manipulations. The number of articulations is limited, particularly by cost constraints. Moreover, generally desired is that the width of the closure in the closed position allows the closure to be hidden under the bracelet, whereas its thickness must be reduced for reasons of comfort and aesthetics. For all these reasons, the number of usable constructions is limited in actual fact, and all involve relatively long plates. For example, if the clasp is formed by two plates folding up one on the other, the length of the plates in closed position must be at least five centimeters to allow a spreading out of five centimeters in opened position. With three plates folding up in accordion fashion, one on the other, the length of the plates and the clasp in closed position is more than 2.5 centimeters, for example. It is difficult to go beyond three superimposed plates without increasing the thickness of the closure in an unacceptable way.

The length of the unfolding clasp in closed position thus has to be rather large. Consequently, the plates forming the clasp are generally curved to correspond approximately to the curvature of the wrist of the wearer of the watch. The adopted curvature must necessarily be a compromise corresponding to a common wrist size, and thus does not fit very thin wrists or the contrary, wrists wider than average. For this reason, many people are of the opinion that bracelets or bands with unfolding clasps are not very comfortable, and nevertheless prefer the less practical bracelets or bands of the open type.

Telescopic unfolding clasps or those of variable length have been proposed, for example, in CH 668 353 and EP 0 453 635. These devices are however of complex construction and fragile.

SUMMARY OF THE INVENTION

One object of the present invention is to propose an unfolding clasp for a bracelet or band which is improved over the prior art unfolding clasps, in particular a more comfortable unfolding clasp.

This object is attained by means of an unfolding clasp having the features of the characterising part of claim 1, preferred embodiments being indicated moreover in the dependent claims.

More specifically, this object is achieved by means of an unfolding clasp comprising at least two plates articulated with respect to one another in such a way as to enable adjustment of the opening of the bracelet, wherein the said plates are made of a flexible material able to adopt the shape of the wrist of the wearer of the watch.

Therefore, instead of being made of a rigid material as the majority of prior art unfolding clasps, the unfolding clasp according to the invention is made of a flexible material, for example a plastic, composite or elastic metallic material.

The patent document EP 0 453 635, cited above, already takes an unfolding clasp of plastic material into account. Nevertheless, use of a flexible or elastic material is not mentioned anywhere. Any possible deformation is even prohibited by the large thickness of the unfolding clasp in closed position. Another non-flexible unfolding clasp is described in EP 0 199 708.

One skilled in the art will note that the deformability of the plates of the unfolding clasp facilitates at the same time the passage of the hand through the bracelet when the clasp is unfolded. The extension of the clasp needed for slipping on the bracelet can thus be reduced, which allows use of smaller plates and therefore also increases the comfort.

According to the invention, the plates of the unfolding clasp are deformable in the direction perpendicular to their own plane, so that the curvature of the closed clasp can fit the shape of the wrist. It is however preferable that the plates cannot be deformed in another direction in order too ensure a certain rigidity of the assembly and to prevent the plates of the clasp from going beyond the bracelet in closed position and from becoming visible when they are laterally deformed. According to the invention, the plates of the clasp are thus made of an anisotropic material, i.e. the deformation of the plates caused by a force applied perpendicular to the plane (x, z) containing the said plates is greater than the deformation of the plates caused by an identical force applied in any other direction. The plates can also be made of isotropic elements put together in such a way that the assembled clasp has anisotropic properties.

In a preferred variant of the invention, the plates of the bracelet are made of a composite material.

BRIEF DESCRIPTION OF THE DRAWINGS

The invention will be better understood from reading the description, given by way of and illustrated with the figures:

FIG. 1 a view in perspective of an unfolding clasp in closed position, shown in two positions of deformation of the plates;

FIG. 2 a view in perspective of the same unfolding clasp in opened position;

FIG. 5 is cross section through the same unfolding clasp in closed position;

FIG. 6 is cross section through the same unfolding clasp in opened position.

DETAILED DESCRIPTION OF PREFERRED EMBODIMENTS

Figures 3, 4:
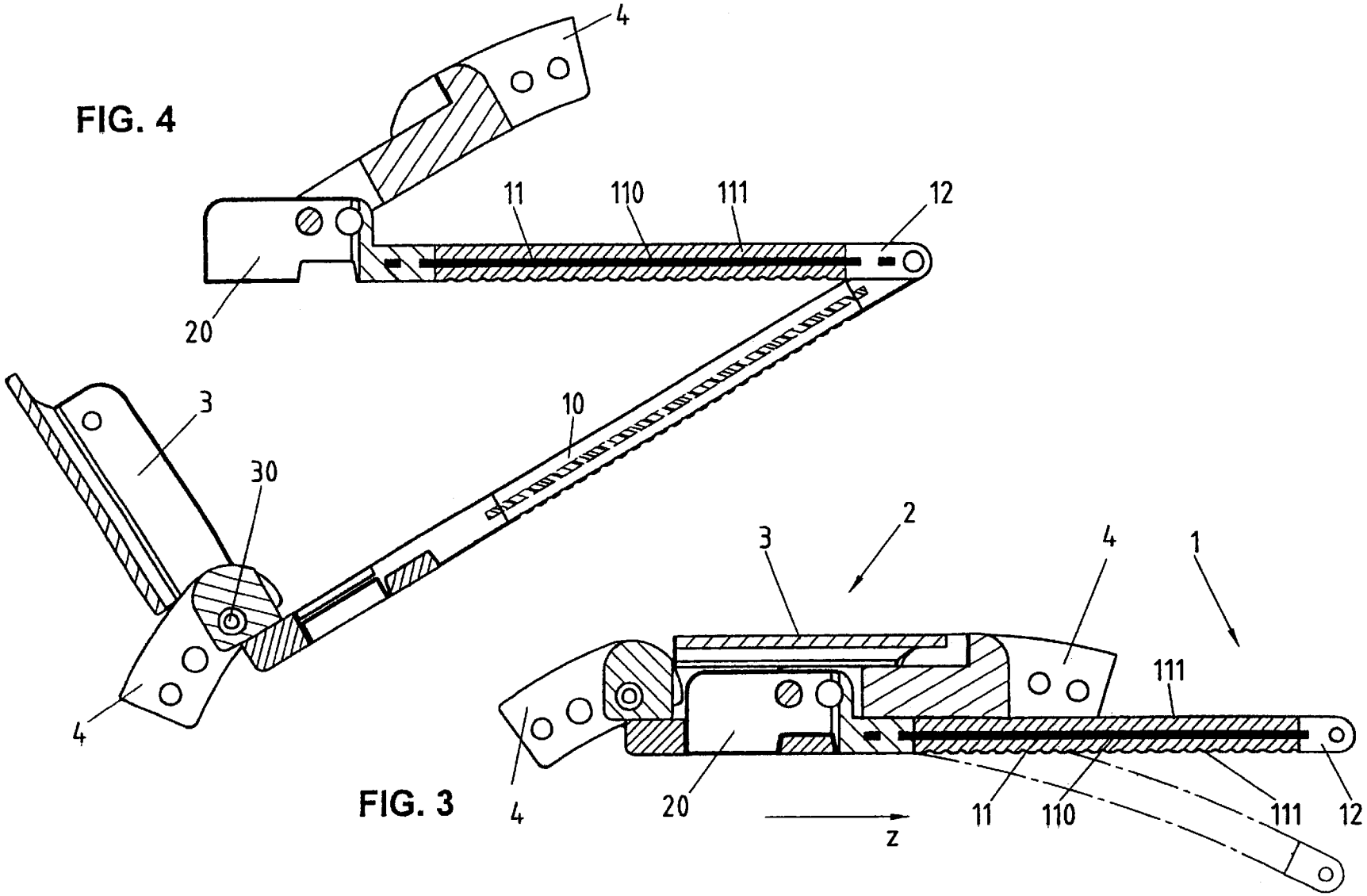
FIG. 3 is longitudinal section through the same unfolding clasp in closed position, show in two positions of deformation of the plates.
FIG. 4 is longitudinal section through the same unfolding clasp in opened position.

The unfolding clasp described by way of example in FIGS. 1 to 6 generally comprises the clasp itself 1 formed by two lateral plates 10 connected by means of a hinge 12 to a central plate 11, as well as a closure 2. As can be seen particularly in FIG. 2, the end of the central plate 11 is connected in an articulated way to a portion of the bracelet 4 whereas the end of the lateral plates 10 is connected by means of another hinge to another portion of the bracelet 4. Only the first metallic links of the two ends of the bracelet 4 are shown in the figures. It is clear that the bracelet could also be made of leather, plastic, ceramic or any other suitable material.

In closed position, as in FIGS. 1, 3 and 5, the central plate 11 is accommodated between the lateral plates 10 and in the same plane x, z, the closure 2 allowing this closed position to be maintained. The closure 2 generally comprises clips 20, which are integral with the central plate 11, as well as retention means 23, integral with the lateral plates 10 and with the other portion of the bracelet. In this example, the clips 20 are made up of a fork-shaped element 20 which engages itself in the portion 23 at the end of the lateral plates 10. The closure is closed simply by pressing on the fork-shaped element 20 or on the last link 4, and is maintained by the oblique portions of the lateral flanks of the plates 10 or of the base of the closure. To open the closure, it is necessary, on the other hand, to press on the ends 200 of the fork-shaped element in such as way as to bring closer together its two branches and to release it and the retention means 23.

A securing covering cap 3, articulated about an axis 30, can be closed over the closure so as to completely conceal the fork-shaped element 20 and the retention means 23. This optional covering cap provides additional security against any accidental opening of the closure owing to an impact on one of the two portions 200 of the fork-shaped element. The covering cap is kept closed by projections 31 engaged in holes 40 on a part integral with the bracelet link 4.

According to the invention, as can be seen in particular in FIGS. 5 and 6, the plates 10, 11 of the clasp 1 are made of a flexible material, preferably of an anisotropic material having a high flexibility along the y axis perpendicular to the plane of the plates of the clasp and a much lower flexibility along the x axis parallel to the axis of the wrist. The unfolding clasp 1 can also be deformed in such a way as to fit the curvature of the wrist, as suggested in FIGS. 1 and 3, without being deformed along the x axis. In this example, the plates 10 and 11, are made of a composite material, here, for example, by means of a metallic longitudinal core 100 and 110, respectively, covered by a flexible material 101 and 111, respectively. The plates 10 and 11 are preferably connected to the other metallic or plastic elements of the closure by their respective metallic core 100 and 110. The flexible covering 101 and 111 can be made, for example, of plastic, leather or caoutchouc, preferably a material agreeable to the skin. At the same time, each core 100 and 110 could also be made of another material, for example a plastic more rigid than the outer covering, or of natural or synthetic fibres. Other kinds of materials and other composite structures can, however, be adopted, particularly according to aesthetic considerations. It is likewise possible to cover only one face of the respective central cores 100 and 110 with a flexible material, for example the face close to the wrist for increased wearing comfort, or the outer face for a decorative effect.

Although the description above relates only to the particular case of an unfolding clasp having a central plate connected to one end of the bracelet and two lateral plates intended to be connected to the other end of the bracelet, it is important to see that the invention can be applied without difficulty to any type of unfolding clasp, for example to unfolding clasps of the butterfly type, the Z-type, etc., having two, three or more plates articulated in any way. In particular, the invention applies perfectly well to unfolding clasps having a first plate connected by a first end in an articulated fashion to a first end of the bracelet, a second plate intended to be connected by a first end in an articulated fashion to a second end of the bracelet, as well as an intermediate plate, connected in an articulated fashion to the second end of the first plate and to the second end of the second plate.

At the minimum, the unfolding clasp comprises a single plate whose thickness at at least one point is greatly reduced so as to allow a greater elastic deformation at said point or points, which thus act as a hinge for the thicker portions of the plate.

To maintain the flexibility of the clasp, use of the types of unfolding clasps in which the plates are not superimposed in closed position is nevertheless preferable.

In one embodiment the clasp is noteworthy in that on the one hand, it is made by an articulated mechanical assembly of at least two distinct plates 10, 11 and, on the other hand, at least one of these plates is made up in such a way as to be deformable substantially in one direction allowing adaptation of the clasp to the curvature of a wrist.

According to another embodiment, the clasp is noteworthy in that on the one hand, it is made by an articulated mechanical assembly of at least two distinct plates 10, 11 and, on the other hand, at least one of these plates 10, 11 is made up of an anisotropic material so as to be elastically deformable substantially in one direction permitting adaptation of the clasp to the curvature of a wrist.

According to another embodiment, the clasp is noteworthy in that on the one hand, it comprises at least two plates 10, 11 made up of isotropic elements 100, 110, and on the other hand, these elements are assembled in such a way that the clasp is elastically deformable substantially in one direction allowing its adaptation to the curvature of a wrist.

The expression "articulated mechanical assembly" refers to an assembly of pieces which involves at least one axis of articulation.

What is claimed is:

1. An unfolding clasp (1) for a bracelet (4), comprising at least one plate (10, 11) articulated so as to be able to ensure opening of the bracelet, characterised in that each plate of the at least one plate is made of a flexible material able to adopt the shape of the wrist of the wearer of the bracelet.

2. The unfolding clasp according to claim. 1, characterised in that a deformation of the clasp caused by a force applied perpendicular to a plane (x, z) containing a plate of the at least one plate is greater than a deformation of the clasp caused by an identical force applied in any other direction.

3. The unfolding clasp according to claim 2, characterised in that the deformation of any plate of the at least one plate caused by a force applied perpendicular to the plane (x, z) containing any plate of the at least one plate is greater than the deformation caused by an identical force applied in any other direction.

4. The unfolding clasp according to claim 1, characterised in that each plate of the at least one plate is made of a composite material.

5. The unfolding clasp according to claim 4, characterised in that each plate of the at least one plate comprises an elastic core made of a metallic, composite or plastic core (100, 110).

6. The unfolding clasp according to claim 4, characterised in that at least one face of each plate of the at least one plate is covered by a flexible material (101, 111).

7. The unfolding clasp according to claim 6, characterised in that the flexible material (101, 111) covering each plate of the at least one plate is made up of one of the following materials: caoutchouc, plastic, leather or elastomer.

8. The unfolding clasp according to claim 1, characterised in that the at least one plate comprises at least two plates that fold up in the same plane (x, z) in a closed position.

9. The unfolding clasp according to claim 8, characterised in that the at least one plate comprises a central plate (11) intended to be connected to one end of the bracelet (4) and two lateral plates (10) intended to be connected to the other end of the bracelet (4) and articulated with respect to said central plate.

10. The unfolding clasp according to claim 1, characterised in that the at least one plate comprises:

a first plate intended to be connected by a first end in an articulated fashion to a first end of the bracelet;

a second plate intended to be connected by a first end in an articulated fashion to a second end of the bracelet; and an intermediate plate, connected in an articulated fashion to a second end of the first plate and to a second end of the second plate.

11. The unfolding clasp (1) according to claim 1, characterised in that the at least one plate is made by an articulated mechanical assembly of at least two distinct plates (10, 11), and at least one of the plates is deformable substantially in one direction allowing adaptation of the clasp to the curvature of a wrist.

12. The unfolding clasp (1) according to claim 1, characterised in that the at least one plate is made up by an articulated mechanical assembly of at least two distinct plates (10, 11), and a plate of the at least two distinct plates (10, 11) is made of an anisotropic material so as to be elastically deformable substantially in one direction permitting adaptation of the clasp to the curvature of a wrist.

13. The unfolding clasp (1) according to claim 1, characterised in that a plate of the at least one plate (10, 11) is made of isotropic elements (100, 110), and the isotropic elements are assembled in such a way that the clasp is elastically deformable substantially in one direction allowing its adaptation to the curvature of a wrist.

14. A bracelet or band for a watch equipped with an unfolding clasp (1) according to claim 1.

* * * * *